US007426969B2

(12) United States Patent
Azar

(10) Patent No.: US 7,426,969 B2
(45) Date of Patent: Sep. 23, 2008

(54) BITS AND CUTTING STRUCTURES

(75) Inventor: Michael George Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/967,584

(22) Filed: Oct. 18, 2004

(65) Prior Publication Data

US 2005/0133278 A1 Jun. 23, 2005

Related U.S. Application Data

(63) Continuation of application No. 10/738,629, filed on Dec. 17, 2003.

(51) Int. Cl.
*E21B 10/42* (2006.01)

(52) U.S. Cl. ..... 175/426; 175/434

(58) Field of Classification Search ..... 175/426, 175/434, 425

See application file for complete search history.

(56) References Cited

U.S. PATENT DOCUMENTS

| | | | | |
|---|---|---|---|---|
| 4,244,432 | A | 1/1981 | Rowley et al. | |
| 4,624,830 | A | 11/1986 | Barr | |
| 4,660,659 | A * | 4/1987 | Short et al. | 175/431 |
| 4,883,132 | A * | 11/1989 | Tibbitts | 175/65 |
| 4,926,950 | A | 5/1990 | Zijsling | |
| 5,199,832 | A * | 4/1993 | Meskin et al. | 408/145 |
| 5,282,513 | A * | 2/1994 | Jones | 175/434 |
| 5,954,147 | A * | 9/1999 | Overstreet et al. | 175/374 |
| 6,009,962 | A * | 1/2000 | Beaton | 175/426 |
| 6,241,036 | B1 * | 6/2001 | Lovato et al. | 175/432 |
| 7,234,550 | B2 * | 6/2007 | Azar et al. | 175/432 |
| 2002/0125048 | A1 | 9/2002 | Traux et al. | |

FOREIGN PATENT DOCUMENTS

| | | |
|---|---|---|
| DE | 27 30 602 | 2/1981 |
| EP | 0 032 428 | 7/1981 |
| EP | 0 145 421 | 6/1985 |
| EP | 0 608 112 | 7/1994 |

OTHER PUBLICATIONS

Combined Search and Examination Report dated Apr. 22, 2005; Application No. GB0427233.2 (7 pages).
Office Action issued in corresponding Canadian Patent Appl. No. 2,489,709; Dated Apr. 27, 2006; 3 pages.
Examination Report issued in Application No. GB0607284.7, dated Nov. 2, 2007 (2 pages).
English translation of Official Action dated Jan. 3, 2006.
Official Action dated Jan. 3, 2006 (3 pages).
Combined Search and Examination Report issued in Application No. GB0607284.7, dated Jun. 16, 2006 (5 pages).

* cited by examiner

*Primary Examiner*—Kenneth Thompson
(74) *Attorney, Agent, or Firm*—Osha Liang LLP

(57) ABSTRACT

This invention provides an improved cutting element for downhole cutting tools comprising a support element and a shearing element disposed on said support; a drill bit insert comprising a body and said cutting element disposed on said body; and a cutting tool, such as a hole opener or a reamer, comprising said cutting element and/or said drill bit insert. Also provided are methods for forming the said cutting element, drill bit insert and downhole cutting tools and a method for drilling mixed earth formation using the improved downhole cutting tools of the present invention.

10 Claims, 10 Drawing Sheets

BITS AND CUTTING STRUCTURES

CROSS-REFERENCE TO RELATED APPLICATIONS

This application is a continuation, and claims benefit to under 35 U.S.C. § 120, of U.S. patent application Ser. No. 10/738,629, filed Dec. 17, 2003 which is hereby incorporated by reference in its entirety.

BACKGROUND OF INVENTION

1. Field of the Invention

The present invention relates generally to downhole cutting tools used in the oil and gas industry.

2. Background Art

Rotary drill bits with no moving elements on them are typically referred to as "drag" bits. Drag bits are often used to drill very hard or abrasive formations. Drag bits include those having cutting elements attached to the bit body, such as polycrystalline diamond compact insert bits, and those including abrasive material, such as diamond, impregnated into the surface of the material which forms the bit body. The latter bits are commonly referred to as "impreg" bits.

An example of a prior art diamond impregnated drill bit is shown in FIG. 1. The drill bit 10 includes a bit body 12 and a plurality of blades 14 that are formed in the bit body 12. The blades 14 are separated by channels 16 that enable drilling fluid to flow between and both clean and cool the blades 14. The blades 14 are typically arranged in groups 20 where a gap 18 between groups 20 is typically formed by removing or omitting at least a portion of a blade 14. The gaps 18, which may be referred to as "fluid courses," are positioned to provide additional flow channels for drilling fluid and to provide a passage for formation cuttings to travel past the drill bit 10 toward the surface of a wellbore (not shown).

During abrasive drilling with a diamond impregnated bits, the diamond particles scour or abrade away the rock. As the matrix material around the diamond granules crystals is worn away, the diamonds at the surface eventually fall out and other diamond particles are exposed. Diamond impregnated drill bits are particularly well suited for drilling very hard and abrasive formations. The presence of abrasive particles both at and below the surface of the matrix body material ensures that the bit will substantially maintain its ability to drill a hole even after the surface particles are worn down.

Diamond impregnated bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In a typical impreg bit forming process, the shank of the bit is supported in its proper position in the mold cavity along with any other necessary formers, e.g., those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. It has been found, however, that the life of both natural and synthetic diamond is shortened by the lifetime thermal exposure experienced in the furnace during the infiltration process. Accordingly, prior art patents disclose a technique for manufacturing bits that include imbedded diamonds that have not suffered the thermal exposure normally associated with the manufacture of such bits. Such a bit structure is disclosed in U.S. Pat. No. 6,394,202 (the '202 patent), which is assigned to the assignee of the present invention and is hereby incorporated by reference.

Referring now to FIG. 2, a drill bit 20 in accordance with the '202 patent comprises a shank 24 and a crown 26. Shank 24 is typically formed of steel or a matrix material and includes a threaded pin 28 for attachment to a drill string. Crown 26 has a cutting face 22 and outer side surface 30. According to one embodiment, crown 26 is formed by infiltrating a mass of tungsten-carbide powder impregnated with synthetic or natural diamond, as described above.

Crown 26 may include various surface features, such as raised ridges 27. Preferably, formers are included during the manufacturing process, so that the infiltrated, diamond-impregnated crown includes a plurality of holes or sockets 29 that are sized and shaped to receive a corresponding plurality of diamond-impregnated inserts 10. Once crown 26 is formed, inserts 10 are mounted in the sockets 29 and affixed by any suitable method, such as brazing, adhesive, mechanical means such as interference fit, or the like. As shown in FIG. 3, the sockets can each be substantially perpendicular to the surface of the crown. Alternatively, and as shown in FIG. 3, holes 29 can be inclined with respect to the surface of the crown 26. In this embodiment, the sockets are inclined such that inserts 10 are oriented substantially in the direction of rotation of the bit, so as to enhance cutting.

As a result of the manufacturing technique of the '202 patent, each diamond-impregnated insert is subjected to a total thermal exposure that is significantly reduced as compared to previously known techniques for manufacturing infiltrated diamond-impregnated bits. For example, diamonds imbedded according to the '202 patent have a total thermal exposure of less than 40 minutes, and more typically less than 20 minutes (and more generally about 5 minutes), above 1500° F. This limited thermal exposure is due to the hot pressing period and the brazing process. This compares very favorably with the total thermal exposure of at least about 45 minutes, and more typically about 60-120 minutes, at temperatures above 1500° F., that occur in conventional manufacturing of furnace-infiltrated, diamond-impregnated bits. When diamond-impregnated inserts are affixed to the bit body by adhesive or by mechanical means such as interference fit, the total thermal exposure of the diamonds is even less.

Another type of bit is disclosed in U.S. Pat. Nos. 4,823,892; 4,889,017; 4,991,670; and 4,718,505, in which diamond-impregnated abrasion elements are positioned behind the cutting elements in a conventional tungsten carbide (WC) matrix bit body. The abrasion elements are not the primary cutting structures during normal bit use.

A second type of fixed cutter drill bit known in the art are polycrystalline diamond compact (PDC) bits. Typical PDC bits include a bit body which is made from powdered tungsten carbide infiltrated with a binder alloy within a suitable mold form. The particular materials used to form PDC bit bodies are selected to provide adequate toughness, while providing good resistance to abrasive and erosive wear. The cutting elements used on these bits are typically formed from a cylindrical tungsten carbide "blank" or substrate. A diamond "table" made from various forms of natural and/or synthetic diamond is affixed to the substrate. The substrate is then generally brazed or otherwise bonded to the bit body in a selected position on the surface of the body.

The materials used to form PDC bit bodies, in order to be resistant to wear, are very hard and difficult to machine. Therefore, the selected positions at which the PDC cutting elements are to be affixed to the bit body are typically formed substantially to their final shape during the bit body molding process. A common practice in molding PDC bit bodies is to include in the mold at each of the to-be-formed cutter mounting positions, a shaping element called a "displacement." A displacement is generally a small cylinder made from graphite or other heat resistant material which is affixed to the inside of the mold at each of the places where a PDC cutter is to be located on the finished drill bit. The displacement forms the shape of the cutter mounting positions during the bit body molding process. See, for example, U.S. Pat. No. 5,662,183 issued to Fang for a description of the infiltration molding process using displacements.

FIG. 4 shows a prior art PDC drill bit. In FIG. 4, the bit body 100 has thereon a plurality of blades 110. Each of the blades 110 has mounted thereon on mounting pads (shaped according to FIG. 3) a PDC cutting element 112. Each PDC cutting element 112 includes a diamond table 113 affixed to a tungsten carbide substrate 114. The bit body 100 includes suitably positioned nozzles or "jets" 120 to discharge drilling fluid in selected directions and at selected rates of flow.

Different types of bits are selected based on the primary nature of the formation to be drilled. However, many formations have mixed characteristics (i.e., the formation may include both hard and soft zones), which may reduce the rate of penetration of a bit (or, alternatively, reduces the life of a selected bit) because the selected bit is not preferred for certain zones. One type of "mixed formation" include abrasive sands in a shale matrix. In this type of formation, if a conventional impregnation bit is used, because the diamond table exposure of this type of bit is small, the shale can fill the gap between the exposed diamonds and the surrounding matrix, reducing the cutting effectiveness of the bit (i.e., decreasing the rate of penetration (ROP)). In contrast, if a PDC cutter is used, the PDC cutter will shear the shale, but the abrasive sand will cause rapid cutter failure (i.e., the ROP will be sufficient, but wear characteristics will be poor).

When drilling a typical well, a bit is run on the end of a bottom hole assembly (BHA) and the bit drills a wellbore with a selected diameter. However, during drilling operations, it may be desirable to increase a diameter of a drilled hole to a selected larger diameter. Moreover, increasing the diameter of the wellbore may be necessary if, for example, the formation being drilled is unstable such that the wellbore diameter decreases after being drilled by the drill bit. Accordingly, tools such as "hole openers" and "underreamers" have been designed to enlarge diameters of drilled wellbores. These types of tools also may be thought of as using fixed cutters.

In some drilling environments, it may be advantageous, from an ease of drilling standpoint, to drill a smaller diameter hole (e.g., and 8½ inch diameter hole) before opening the hole to a larger diameter (e.g., to a 17½ inch diameter hole) with a hole opener. Moreover, it is difficult to directionally drill a wellbore with a large diameter bit because, for example, larger diameter bits have an increased tendency to "torque-up" (or stick) in the wellbore. When the larger diameter bit torques-up, the bit tends to stick and drill a tortuous trajectory while periodically sticking and then unloading torque. Therefore it is often advantageous to directionally drill a smaller diameter hole before running a hole opener in the wellbore to increase the wellbore to a desired larger diameter.

A typical prior art hole opener is disclosed in U.S. Pat. No. 4,630,694 issued to Walton et al. The hole opener includes a bull nose, a pilot section, and an elongated body adapted to be connected to a drillstring used to drill a wellbore. The hole opener also includes a triangularly arranged, hardfaced blade structure adapted to increase a diameter of the wellbore.

Another prior art hole opener is disclosed in U.S. Pat. No. 5,035,293 issued to Rives. The hole opener may be used either as a sub in a drillstring or may be run on the end of a drillstring in a manner similar to a drill bit. The hole opener includes radially spaced blades with cutting elements and shock absorbers disposed thereon. As described in detail below, embodiments of the present invention relate to hole opening technology in addition to bits, typically found at the end of a BHA.

What is still needed, however, are improved cutting structures that are suited to drill various types of formation.

SUMMARY OF INVENTION

In one aspect, the present invention relates to a cutting element for a downhole cutting tool including a support element, a shearing element disposed on said support, wherein the shearing element is disposed proximal to a leading edge of the downhole cutting tool, and a retaining element overlaying at least a portion of said shearing element.

In one aspect, the present invention relates to a cutting element for a downhole cutting tool including a support element, a shearing element disposed on said support, wherein the shearing element is disposed proximal to a leading edge of the downhole cutting tool to provide substantially continuous thermally stable polycrystalline diamond exposure during drilling.

In one aspect, the present invention relates to a drill bit including a bit body having at least one support with at least one thermally stable polycrystalline diamond shearing element disposed on the at least one support. At least one other shearing element disposed on the at least one support. Additionally, at least one retaining element overlays at least a portion of the thermally stable polycrystalline diamond shearing element.

Other aspects and advantages of the invention will be apparent from the following description and the appended claims.

DETAILED DESCRIPTION

Figure 1:
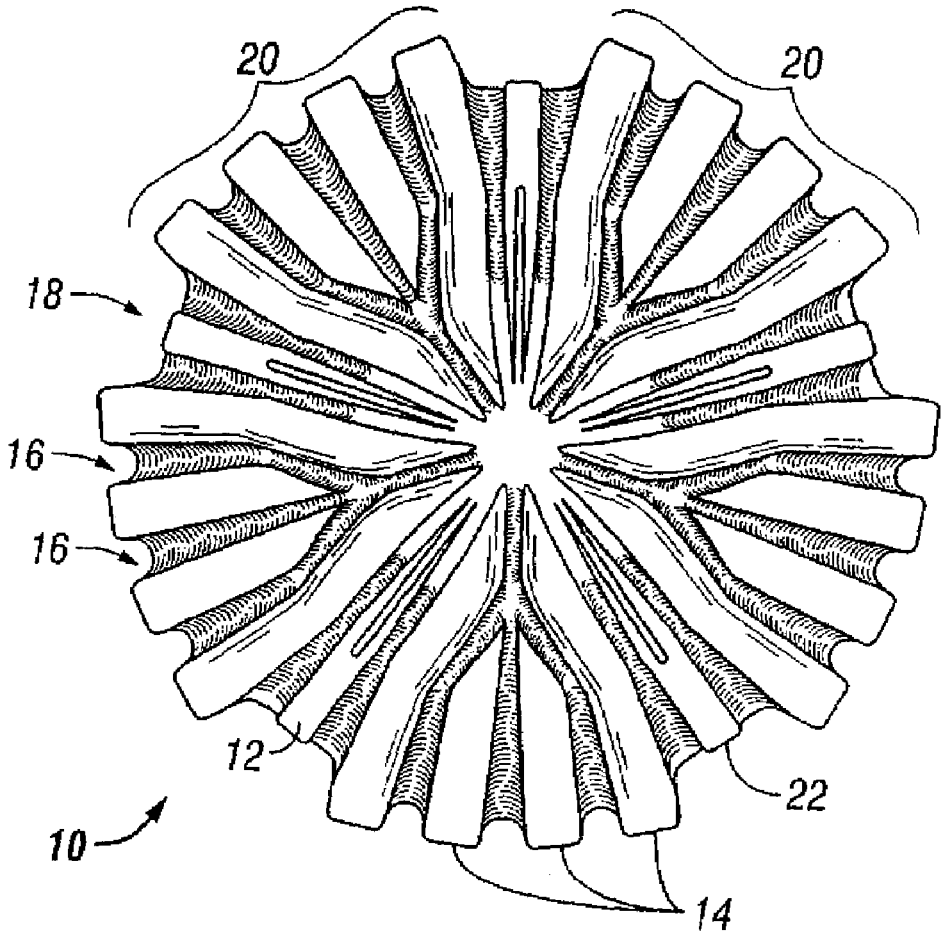
FIG. 1 (PRIOR ART)
FIG. 1 shows a prior art diamond impregnated bit.
Figure 2:
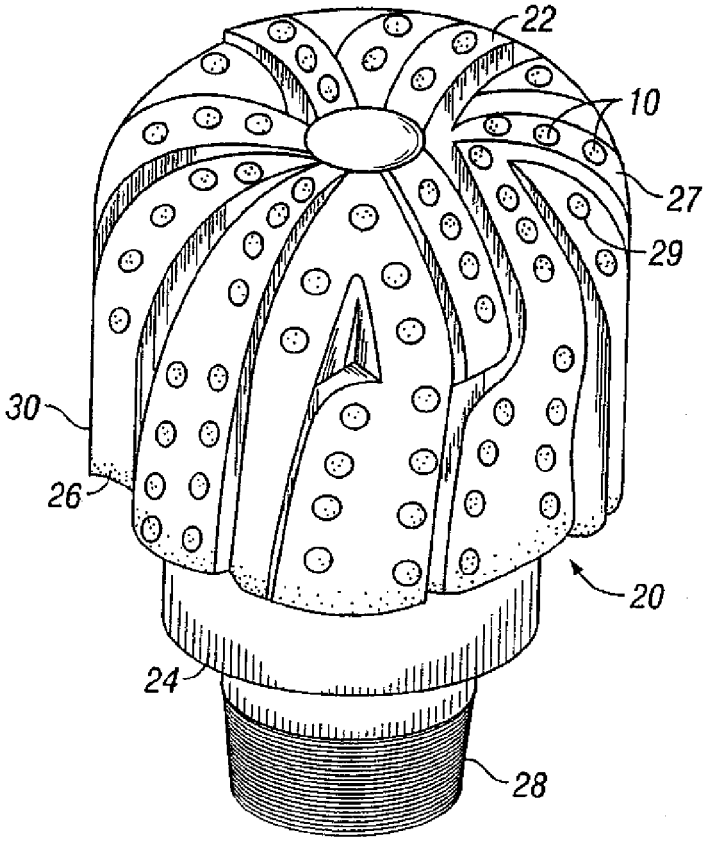
FIG. 2 (PRIOR ART)
FIG. 2 is a perspective view of a second type of diamond impregnated bit.
Figure 3:
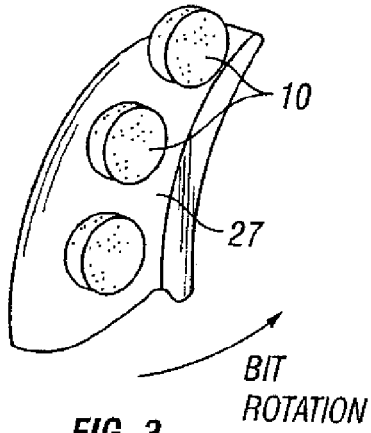
FIG. 3 (PRIOR ART)
FIG. 3 shows rotated inserts.
Figure 4:
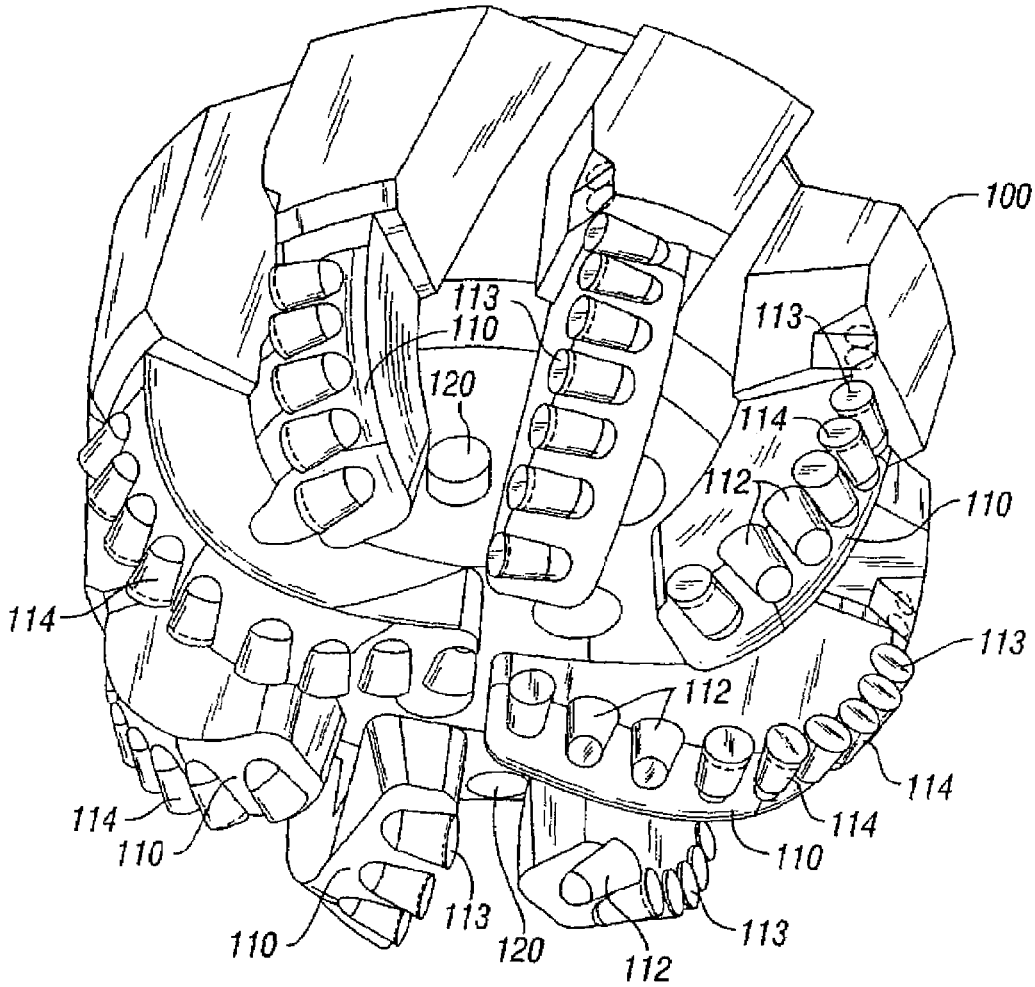
FIG. 4 (PRIOR ART)
FIG. 4 shows a prior art PDC drill bit.

In one aspect, the present invention relates to cutting structures that use a shearing element, disposed on a support. In particular, the present invention relates to cutting structures for use in lieu of, or in combination with, PDC cutter elements to provide a shearing action. Moreover, embodiments of the present invention are particularly useful in high speed applications, such as applications that use a mud motor and/or turbines.

According to some embodiments, a cutting structure that comprises a shearing element (which may comprises thermally stable polycrystalline diamond (TSP)) is disposed on a support. In some embodiments, the support comprises diamond impregnated material. The shearing element may be formed from a number of compounds, such as cubic boron nitride (CBN), PDC, or TSP.

In some embodiments, at least a portion of the shearing element is overlayed by a retaining element to provide an additional retention mechanism to prevent the shearing element from dislodging from the support. In some embodiments, the retaining element may be integrally formed with the support. In other embodiments the retaining element may be discretely formed from either the same composition as the support or a different composition.

In particular, in some embodiments of the present invention, diamond impregnated blades, which are used in lieu of the matrix or steel blades commonly used in PDC bits, provide the support for a thermally stable polycrystalline diamond shearing element.

The manufacture of TSP is known in the art, but a brief description of a process for manufacturing TSP is provided herein for convenience. When formed, diamond tables comprise individual diamond "crystals" that are interconnected. The individual diamond crystals thus form a lattice structure. Binder material, such as cobalt particles, is often found within the interstitial spaces in the diamond lattice structure. Cobalt has a significantly different coefficient of thermal expansion as compared to diamond, so upon heating of the diamond table, the cobalt will expand, causing cracks to form in the lattice structure, resulting in deterioration of the diamond table.

In order to obviate this problem, strong acids are used to "leach" the cobalt from the diamond lattice structure. Removing the cobalt causes the diamond table to become more heat resistant, but also causes the diamond table to be more brittle. Accordingly, in certain cases, only a select portion (measured either in depth or width) of a diamond table is leached, in order to gain thermal stability without losing impact resistance. As used herein, the term TSP includes both of the above (i.e., partially and completely leached) compounds.

As a result of these structures, embodiments of the present invention provide a "shear bit" with shearing cutting elements positioned at a leading edge of the blade that are supported by a selected material. In some embodiments, the shearing element (which may be TSP), is coated with a titanium carbide or silicon carbide coating, to enhance its retention through chemical means. Further, the shearing element may be shaped, as discussed with reference the FIGS. below, to mimic the shapes of traditional PDC cutters or, depending on the application, to have other selected geometries.

Figure 5A:
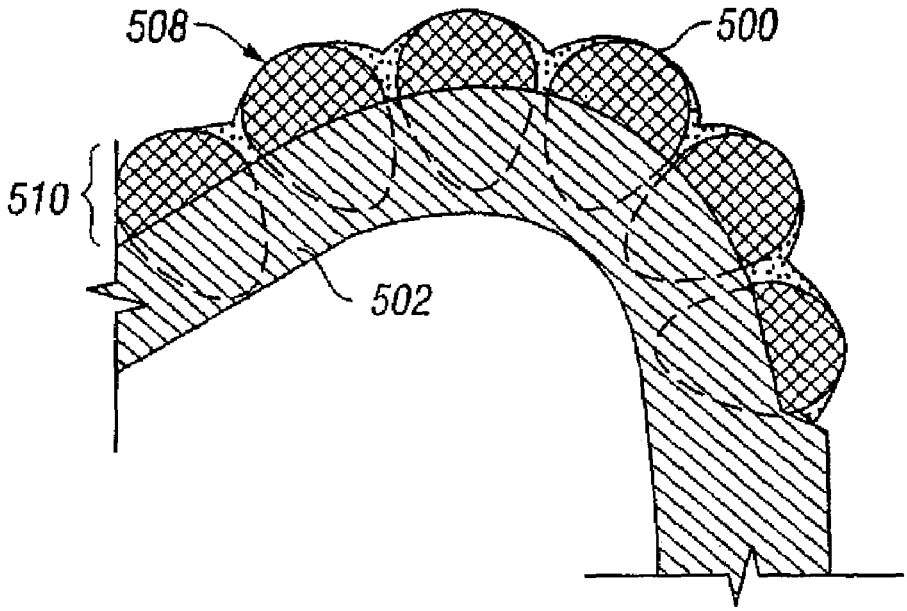
FIGS. 5*a*-5*b* show a cutting structure formed in accordance with an embodiment of the present invention.
Figure 5B:
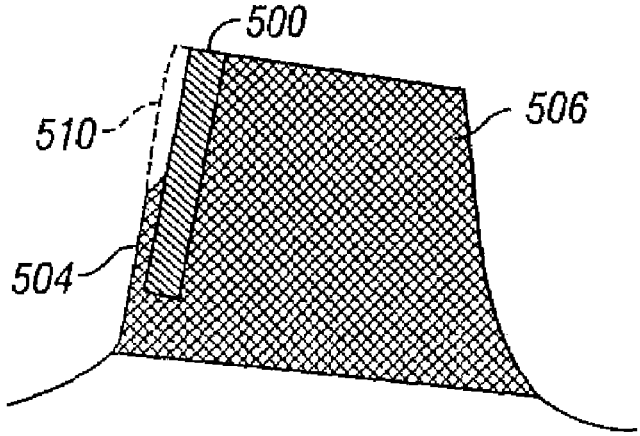

A cutting structure in accordance with an embodiment of the present invention is now described, with reference to FIGS. 5A and 5B. In FIG. 5A, a support 502 is shown. In certain embodiments, the support 502 comprises a diamond impregnated support. In the embodiment shown in FIG. 5A, the support 502 comprises a blade, as is known for PDC bits. Shaped shearing elements 500, are disposed at selected locations on the support 502. In this embodiment, the shaped shearing elements 500 comprise thermally stable polycrystalline diamond. The shearing elements 500 are placed proximal to a leading edge 508. Moreover, in this embodiment, a retaining portion 504 is provided to cover at least a portion of the shaped shearing element 500 (as shown in FIG. 5B).

In this embodiment, the retaining portion 504 is formed from the support 502, and is created during the manufacturing process. However, in other embodiments, the retaining portion may comprise a discretely applied support, which may be formed from non-infiltrated tungsten carbide, or other suitable materials (such as boron nitride). By covering at least a portion of the shearing elements 500, the retaining portion 504 provides a "mechanical" retention mechanism, and decreases the likelihood of the shearing element 500 coming free from the support 502.

Moreover, in FIGS. 5A and 5B, the shearing elements 500 are shown having a "teardrop" shape, so that an exposed portion 510 (i.e., the portion of the shearing element 500 not covered by the retaining portion 504) mimics the shape of a typical PDC cutter. Because the shearing elements 500 can be so shaped, and because the support can be molded into the shape of a blade, embodiments of the present invention can be used in applications where PDC bits are typically used. Thus, embodiments of the present invention provide the advantages of PDC bits, such as shearing action and hydraulics cleaning. In some embodiments, these advantages may be realized without the limitation of high wear in abrasive formations that PDC bits typically experience, because TSP may be used as a shearing element.

The shearing elements 500 in FIG. 5B are backed by a material 506 on the drill bit (not shown). The backing material 506 provides support for the shearing element 500 during the drilling process. The backing material may comprise a diamond impregnated material. In other embodiments, the backing material may be tungsten carbide.

Figure 6:
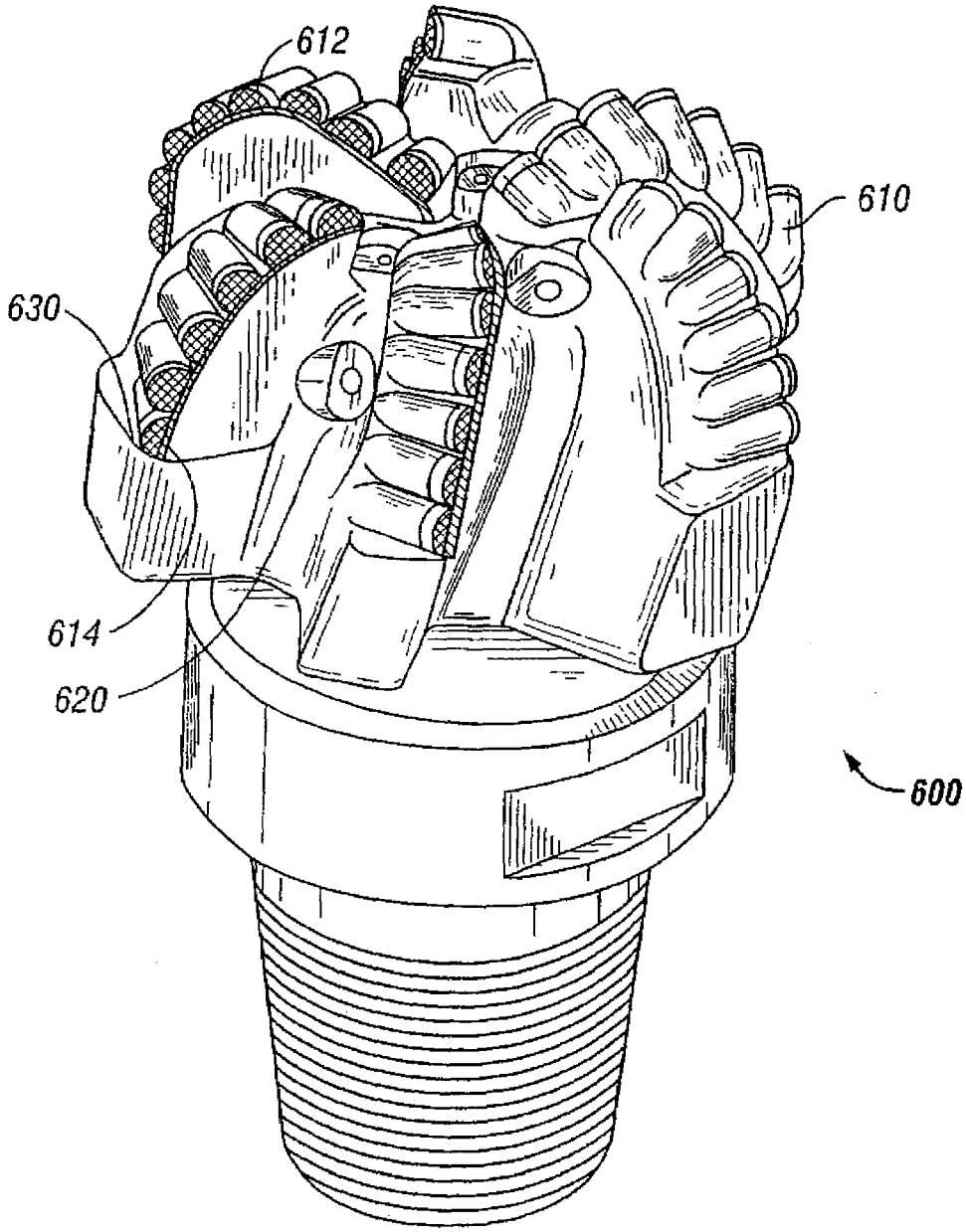
FIG. 6 shows a drill bit formed using cutting structures in accordance with embodiments of the present invention.

FIG. 6 illustrates a drill bit having cutting elements formed in accordance with an embodiment of the present invention. In FIG. 6, a bit body 600 has a plurality of blades 610 extending from the bit body 600. In this embodiment, the blades 610 are formed from diamond impregnated material, which may be manufactured using any technique known in the art. The bit body 600 itself may also be formed from diamond impregnated material, or may be formed of a high strength matrix material (known to those having ordinary skill in the art), or may be steel (which may be overlayed with hardfacing).

The blades 610 have cutting elements 612 mounted at select locations. The cutting elements 612 include a shearing element, comprising thermally stable polycrystalline diamond supported by diamond impregnated material, that forms the blades 610. Moreover, a retaining portion 614 is disposed over at least a portion of the cutting elements 612, to help prevent cutting element 612 loss.

The cutting elements 612 are arranged proximal to a leading edge 630 of the blades 610, such that the shearing portion (not separately numbered) contacts the formation to be drilled. The shearing element is so disposed to provide substantially continuous shearing engagement with an earth formation during drilling. Furthermore, the bit body 600 includes suitably positioned nozzles or "jets" 620 to discharge drilling fluid in selected directions and at selected rates of flow.

Figure 11:
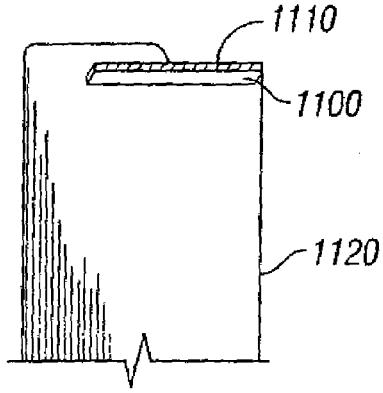
FIG. 11 shows a coated TSP shearing element in accordance with an embodiment of the present invention.

Moreover, in certain embodiments, the shearing element may be coated with a material to either create or enhance a bond between the support (e.g., the blades 610 in the embodiment described above) and the shearing element (e.g., cutting element 612 in the embodiment described above). In various embodiments, the coating may comprise a titanium based coatings, tungsten based coatings, nickel coatings, silicon coatings, various carbides, nitrides, and other materials known to those skilled in the art. In particular embodiments, a TSP shearing element is provided with a titanium or silicon carbide coating. FIG. 11 illustrates a titanium carbide coating 1110 deposited on shearing element 1100, which is disposed on support 1120. In another embodiment, the coating comprises silicon carbide.

Figure 7A:
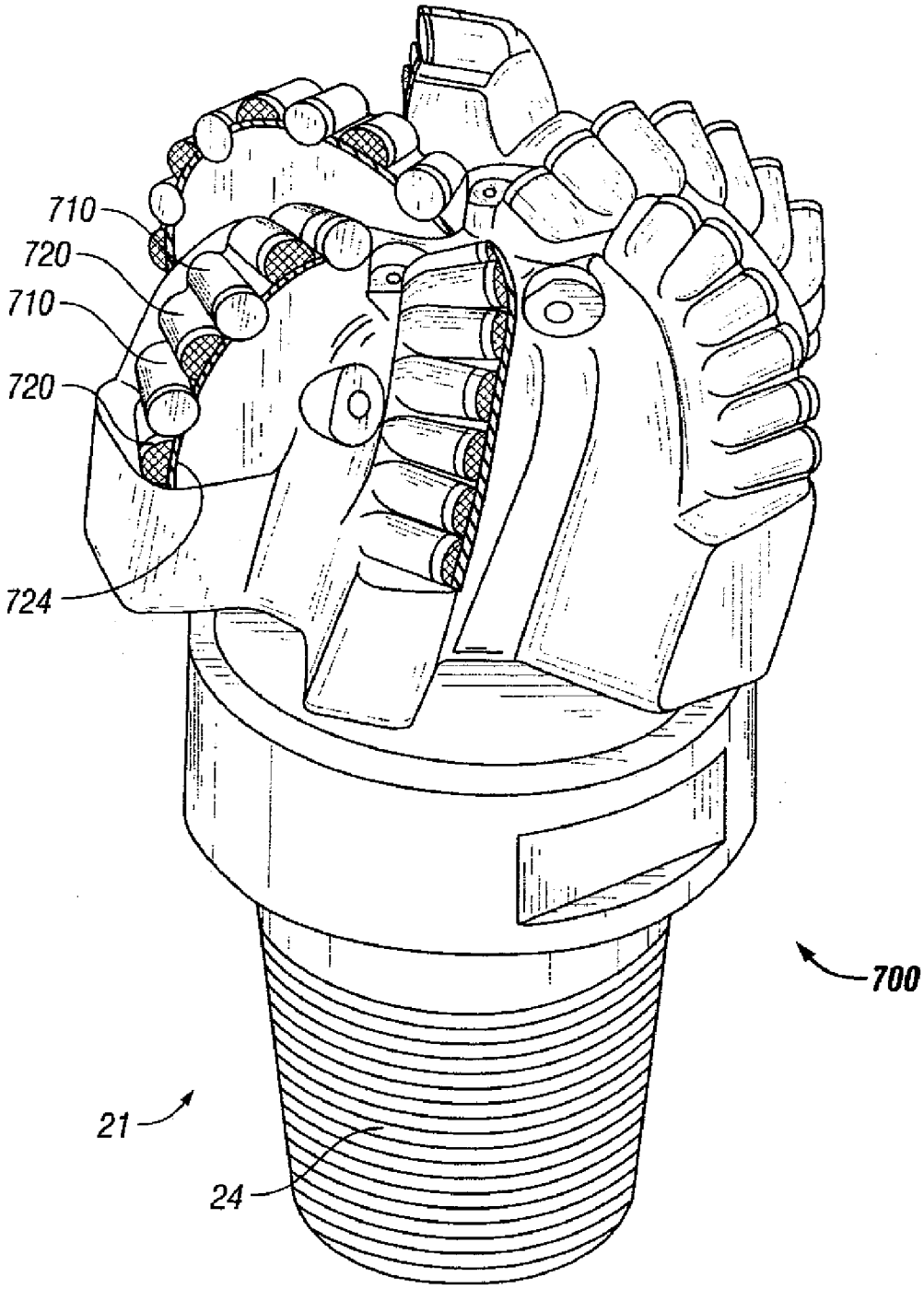
FIG. 7A shows a drill bit formed using cutting structures formed in accordance with embodiments of the present invention that further includes PDC cutting elements.

FIG. 7A illustrates another embodiment of the present invention. In this embodiment, shearing elements formed in accordance with an embodiment of the present invention are used in combination with standard PDC inserts. In particular, as shown in FIG. 7A, two groups of cutting elements 710, 720 are shown extending from bit body 700. The first group of cutting elements 710, which extend slightly further and, therefore, will engage the formation first, comprise PDC inserts. The PDC inserts comprise a cylindrical tungsten carbide substrate to which a diamond table made from various forms of natural and/or synthetic diamond is affixed. The substrate is brazed or otherwise bonded to the bit body 700 in a selected position.

The second group of cutting elements 720 comprise a shearing element having a retaining portion 724 disposed over at least a portion of the cutting elements 720 to help prevent cutting element 720 loss.

When drilling, the first group of cutting elements 710 (which include the "standard" PDC cutters) interact with the formation first. After drilling for a period of time, the PDC cutting elements 710 will begin to wear. At some point during the drilling process, the diameter of the PDC cutters will wear to the point where the cutting elements 720 begin to interact with and shear the formation.

In some embodiments, the shearing elements (which may comprise TSP) may be disposed to follow or track PDC cutters (on the same radius) to minimize PDC wear progress. In other embodiments, the shearing elements may be arranged at a different exposure than the PDC cutter where the diamond volume (assuming that the shearing element comprises diamond) increases once PDC cutters are worn beyond a certain degree (i.e., both sets of cutting elements begin to interact with the formation). Also, in some embodiments, the different cutting elements may alternate where elements having similar characteristics track. The higher wear on the PDC cutters will leave more pronounced scallops on the hole bottom to stabilize the bit and reduce vibration.

This structure for a drill bit, which uses two different types of cutters, is particularly advantageous for formations that go from "soft" to "hard." PDC cutters wear relatively quickly in hard formations, causing a significant drop in the rate of penetration (ROP). However, by using a structure as described above, the TSP cutting elements begin to interact with the formation as the PDC cutters wear, maintaining or even increasing ROP.

Again, it is noted that while reference has been made to particular compositions and structures in the above embodiments, the present invention is not so limited. In particular, embodiments of the present invention relate to a shearing element disposed on a support, the shearing element being disposed to provide shearing engagement with an earth formation during drilling. In certain embodiments, the shearing element may be formed from TSP, CBN, and/or polycrystalline diamond.

Figure 7B:
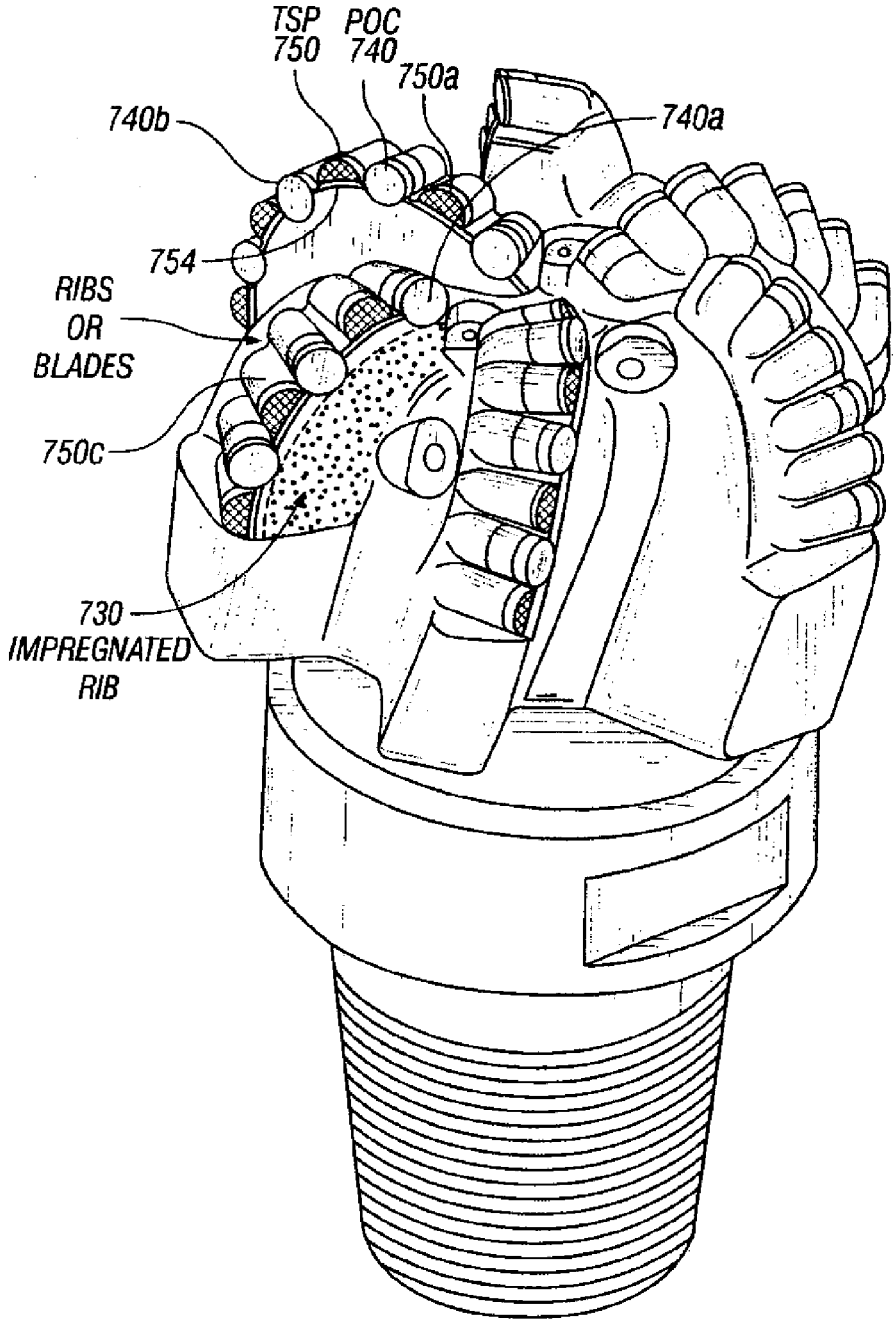
FIG. 7B shows a drill bit formed using cutting structures formed in accordance with embodiments of the present invention that further includes PDC cutting elements.

Further, as shown in FIG. 7B, in certain embodiments, the support 730 comprises a diamond impregnated material, but may be formed from matrix materials (any suitable material known in the art), or steel, for example. In some other embodiments, the support 730 is layered with tungsten carbide. Those having ordinary skill in the art will recognize that other materials may be used.

Also, in certain embodiments, the shearing element (e.g., 740, 750) is formed such that the leading edge consists of essentially a single type of material.

Moreover, in certain embodiments, a retaining element 754 is provided. The retaining element 754 may be formed integrally from the support element 730, or may comprise a discrete element that may or may not be formed from the same material as the support 730.

In FIG. 7B, the supports 730 include PDC cutters 740 as well as shear cutters 750. The shear cutters 750 may be formed of TSP, CBN and/or polycrystalline diamond. In some embodiments, a retaining portion 754 covers at least a portion of the shear cutters 750 to help prevent shear cutter loss. In some embodiments, such as the one shown in FIG. 7B, the PDC cutters 740 and the shear cutters 750 are alternately positioned on the support 730. The retention portion 754 is positioned to cover at least a portion of the shear cutters 750, but not any of the PDC cutters 740. Other arrangements of a retention member, such as one that also covers a portion of the PDC cutters, may be used, without departing from the scope of the invention.

The cutters 740, 750 may be arranged on the support 730 to have various positions and exposures that are advantageous for the particular formation to be drilled. In one example, a shear cutter 750*a* is positioned to at least partially track a PDC cutter 740. In another example, a PDC cutter element 740*b* may be positioned to at least partially track a shear cutter 750*b*.

Additionally, the exposures of the cutters 740, 750 may be varied to suit a particular application. In some embodiments, the PDC cutters 740 may have substantially the same exposure as the shear cutters 750. In other embodiments, the PDC cutters 740 and the shear cutters 750 may have different exposures. For example, the PDC cutters 740 may have a higher exposure than shear cutters 750. Alternatively, the shear cutters 750 may have a higher exposure than the PDC cutters.

In addition, some embodiments may be arranged so that a cutting element that partially tracks another cutting element has a different exposure than the cutting element that it tracks. For example, a PDC cutter 740*a* may have a higher exposure than a shear cutter 750*a* that tracks the PDC cutter 740*a*. Alternatively, the shear cutter 750*a* may have a higher exposure than the PDC cutter 740*a* that it tracks. The same is true for a shear cutter 750*b* that is tracked by a PDC cutter 740*b*. The shear cutter 750*b* may have a higher exposure than the PDC cutter 740*b*, or the PDC cutter 740*b* may have a higher exposure than the shear cutter 750*b*.

Figure 7C:
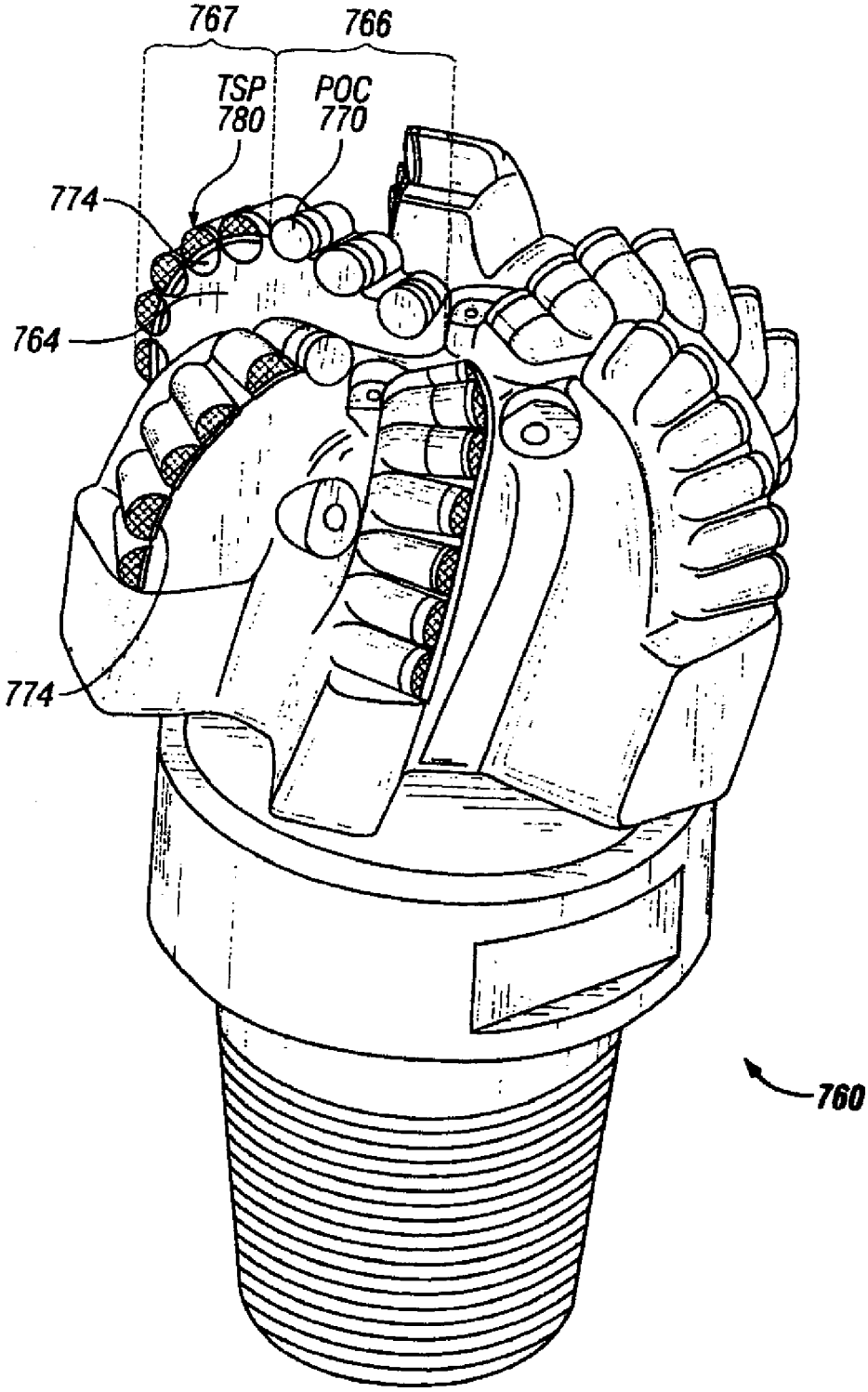
FIG. 7C shows a drill bit formed using cutting structures formed in accordance with embodiments of the present invention that further includes PDC cutting elements.

FIG. 7C shows another embodiment of a drill bit 760 with cutters 770, 780 positioned on a support 764. The inner profile 766, which extends from the axis of the drill bit 760 to a selected radial distance from the axis, is comprised of PDC cutters 770 that are disposed on the support 764. The outer profile 767 of the drill bit 760, which extends from the inner profile 766 to the outside radius of the drill bit 760, is comprised of shear cutters 780 that are disposed on the support 764. The shear cutters 780 may be formed of TSP, CBN and/or polycrystalline diamond. A retaining portion 774 covers at least a portion of the shear cutters 780 to help prevent shear cutter loss. In at least one other embodiment, the inner profile 766 is comprised of shear cutters 780 and the outer profile is comprised of PDC cutters 770.

Figure 8:
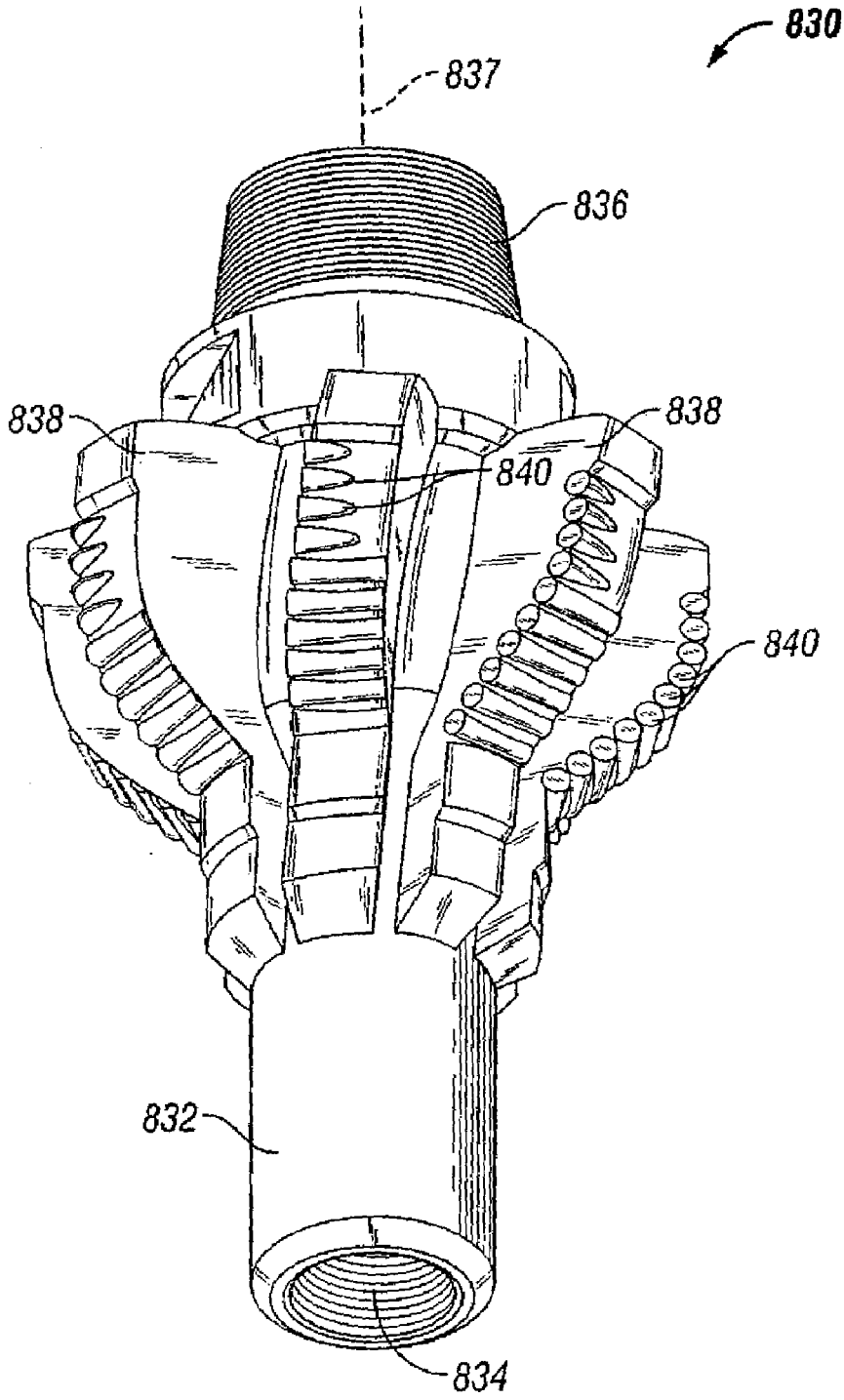
FIG. 8 shows a downhole cutting tool in accordance with one embodiment of the present invention.

In other embodiments of the present invention, cutting structures formed in accordance with the present invention may be used in a downhole drilling tool, which in one embodiment may be a hole opener. FIG. 8 shows a general configuration of a hole opener 830 that includes one or more aspects of the present invention. The hole opener 830 comprises a tool body 832 and a plurality of blades 838 disposed at selected azimuthal locations about a circumference thereof. The hole opener 830 generally comprises connections 834, 836 (e.g., threaded connections) so that the hole opener 830 may be coupled to adjacent drilling tools that comprise, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown). The tool body 832 may be formed from steel or from other materials known in the art. For example, the tool body 832 may also be formed from a matrix material infiltrated with a binder alloy.

The blades 838 shown in FIG. 8 are spiral blades and are generally positioned at substantially equal angular intervals about the perimeter of the tool body so that the hole opener 830. This arrangement is not a limitation on the scope of the invention, but rather is used merely to illustrative purposes. Those having ordinary skill in the art will recognize that any prior art downhole cutting tool may be used. In this embodiment, the blades 838 are formed from matrix material infiltrated with a binder alloy, and cutting elements 840 such as those described above with reference to FIG. 5 are disposed on the blades 838. Other blade arrangements may be used with the invention, and the embodiment shown in FIG. 8 is not intended to be limiting.

Moreover, in addition to downhole tool applications such as a hole opener, reamer, stabilizer, etc., a drill bit using cutting elements according to various embodiments of the invention such as disclosed herein may have improved drilling performance at high rotational speeds as compared with prior art drill bits. Such high rotational speeds are typical when a drill bit is turned by a turbine, hydraulic motor, or used in high rotary speed applications.

As known in the art, various types of hydraulically, pneumatically, or rotary operated motors can be coupled to the bit. These so-called "mud motors" are operated by pumping drilling fluid through them. Generally, there are two basic types of mud motors. One type of motor is called "positive displacement." Positive displacement motors include a chambered stator in the interior of the motor housing which is usually lined with an elastomeric material, and a rotor which is rotationally coupled to the motor output shaft (and thence to the drill bit).

Movement of drilling fluid through chambers defined between the stator and rotor causes the rotor to turn correspondingly to the volume of fluid pumped through the motor. The other type of mud motor is called "turbine," because the output of the motor is coupled to a turbine disposed inside the motor housing. As those having ordinary skill in the art will appreciate, the additional motors cause a higher rotational speed in the bit. By coupling cutting structures in accordance with embodiments of the present invention with motors, turbines, and the like, higher penetration rates can be achieved. The cutting structures in accordance with the present invention provide the necessary flow required, as well as providing the necessary durability, to survive under these conditions.

In one embodiment of the invention, the support (which may comprise the blades and/or the body of the bit) is made from a solid body of matrix material formed by any one of a number of powder metallurgy processes known in the art. During the powder metallurgy process, abrasive particles and a matrix powder are infiltrated with a molten binder material. Upon cooling, the support includes the binder material, matrix material, and the abrasive particles suspended both near and on the surface of the drill bit. The abrasive particles typically include small particles of natural or synthetic diamond. As noted above, synthetic diamond used in diamond impregnated drill bits is typically in the form of single crystals. However, thermally stable polycrystalline diamond (TSP) particles may also be used.

Figure 9:
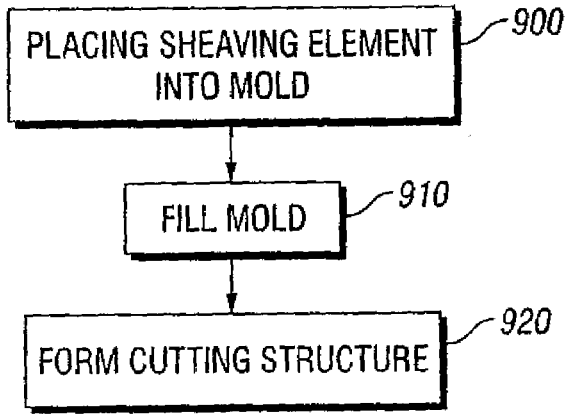
FIG. 9 shows a flow chart illustrating one method of forming a cutting structure in accordance with an embodiment of the present invention

One suitable method of forming a cutting structure in accordance with an embodiment of the present invention is now described, with reference to FIG. 9. In the present invention, as illustrated in FIG. 9, a shaped, shearing element is placed into a mold (step 900). Depending on the embodiments, the shearing element may comprise thermally stable polycrystalline diamond. Further, in certain embodiments, the shearing element may be coated with a chemical coating, such as titanium carbide or silicon carbide. In order to form the retaining portion that overlays the shearing element in embodiments of the present invention, a removable overlay is attached to the shearing element, prior to being placed in the mold. This structure is shown in FIG. 10.

Figure 10:
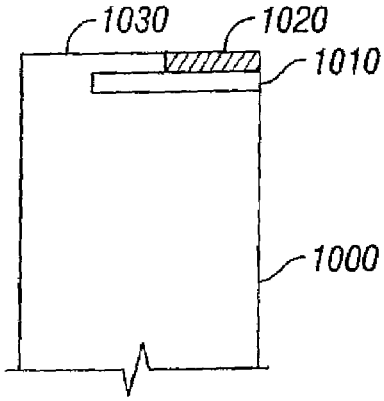
FIG. 10 shows a removable overlay that is attached to a TSP in accordance with an embodiment of the present invention.

In FIG. 10, removable overlay 1020 is shown attached to thermally stable polycrystalline diamond shearing element 1010. The removable overlay 1020 is also shown in contact with mold bottom 1030. The removable overlay 1020 is formed from a material such that during the diamond infiltration process (resulting in the diamond impregnated support) it is destroyed. In one embodiment, the removable overlay 1020 may be formed from sand.

Returning to FIG. 9, after the shearing elements (and the removable overlay) are placed into the mold, one of two steps may occur. A discrete retaining portion may be added or, a "charge" of matrix powder (which may be tungsten carbide) is added to "fill" the mold (step 910).

Finally, a binder, and more specifically an infiltrant, (which may be a nickel brass copper based alloy), along with the diamonds (in the case where the support comprises a diamond impregnated support), is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process (step 920).

The diamond particles which are used to form the matrix powder may be either natural or synthetic diamond, or a combination of both. The matrix in which the diamonds are embedded to form the diamond impregnated material should satisfy several requirements. The matrix preferably has sufficient hardness so that the diamonds exposed at the cutting face are not pushed into the matrix material under the very high pressures encountered in drilling. In addition, the matrix preferably has sufficient abrasion resistance so that the diamond particles are not prematurely released.

To satisfy these requirements, as an exemplary list, the following materials may be used for the matrix in which the diamonds are embedded: tungsten carbide (WC), tungsten alloys such as tungsten/cobalt alloys (W—Co), and tungsten carbide or tungsten/cobalt alloys in combination with elemental tungsten (all with an appropriate binder phase to facilitate bonding of particles and diamonds) and the like. Those of ordinary skill in the art will recognize that other materials may be used for the matrix, including titanium-based compounds, nitrides (in particular cubic boron nitride), etc.

It will be understood that the materials commonly used for construction of bit bodies can be used in the present invention. Hence, in one embodiment, the bit body may itself be diamond-impregnated. In an alternative embodiment, the bit body comprises infiltrated tungsten carbide matrix that does not include diamond. If this is the case, the blades which form the support for the shearing element may or may not be separately formed from diamond impregnated material. In an alternative embodiment, the bit body can be made of steel, according to techniques that are known in the art. The bit can optionally be provided with a layer of hardfacing. Again, if this is the case, the blades may be formed from diamond impregnated material.

Advantageously, cutting structures formed in accordance with embodiments of the present invention provide drill bits and downhole cutting tools that provide good shearing action, even in hard formations. Moreover, embodiments of the present invention provide drill bits and downhole cutting tools that may be run at high speeds (i.e., higher bit RPM's).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutting element for a downhole cutting tool, comprising:

a diamond impregnated support element;

a shearing element disposed on said diamond impregnated support, wherein the shearing element has a coating thereon and is disposed proximal to a leading edge of the downhole cutting tool; and a retaining element overlaying at least a portion of a cutting face of said shearing element.

2. The cutting element of claim 1, wherein said diamond impregnated support element comprises thermally stable polycrystalline diamond.

3. The cutting element of claim 1, wherein said retaining element is integral to the diamond impregnated support element.

4. The cutting element of claim 1, wherein said shearing element comprises at least one selected from the group of polycrystalline diamond, thermally stable polycrystalline diamond, and boron nitride.

5. The cutting element of claim 4, wherein the shearing element is thermally stable polycrystalline diamond.

6. The cutting element of claim 1, wherein said coating comprises at least one selected from a titanium based coating, a tungsten based coating, and a nickel based coating.

7. The cutting element of claim 1, wherein the diamond impregnated support element comprises coated natural diamond.

8. The cutting element of claim 1, wherein the cutting element is disposed on a reamer, stabilizer, or hole opener.

9. The cutting element of claim 1, wherein the cutting element is disposed on a drill bit.

10. A cutting element for a downhole cutting tool, comprising:

a diamond impregnated support element;

a thermally stable polycrystalline diamond shearing element disposed on said diamond impregnated support, wherein the thermally stable polycrystalline diamond shearing element has a coating thereon and is disposed proximal to a leading edge of the downhole cutting tool to provide substantially continuous thermally stable polycrystalline diamond exposure during drilling; and a retaining element overlaying at least a portion of said shearing element.

* * * * *